United States Patent [19]

Butter

[11] 4,297,684

[45] Oct. 27, 1981

[54] FIBER OPTIC INTRUDER ALARM SYSTEM

[75] Inventor: Charles D. Butter, Cologne, Minn.

[73] Assignee: Honeywell Inc., Minneapolis, Minn.

[21] Appl. No.: 24,125

[22] Filed: Mar. 26, 1979

[51] Int. Cl.[3] ..... G08B 13/22; G08B 13/10

[52] U.S. Cl. ..... 340/557; 250/227; 340/565; 340/566; 340/666; 350/96.2

[58] Field of Search ..... 340/557, 565, 566, 666, 340/556, 555, 380; 250/227; 350/96.2, 96.25, 96.1; 455/610

[56] References Cited

U.S. PATENT DOCUMENTS

| | | | |
|---|---|---|---|
| 3,258,762 | 6/1966 | Donner | 340/566 |
| 3,394,976 | 7/1968 | Hawkins | 250/227 |
| 3,940,608 | 2/1976 | Kissinger et al. | 250/227 |
| 4,078,432 | 3/1978 | Stewart | 250/227 |
| 4,095,872 | 6/1978 | Stieff et al. | 350/96.2 |
| 4,106,849 | 8/1978 | Stieff | 350/96.2 |

*Primary Examiner*—Glen R. Swann, III
*Attorney, Agent, or Firm*—Omund R. Dahle

[57] ABSTRACT

An intruder alarm for protecting the perimeter of an area utilizes a multimode optic fiber as the deformable sensing element, wherein a length of multimode optic fiber is buried in the ground of an area or perimeter to be protected. As coherent light from a laser is directed through a length of optic fiber, the output light pattern therefrom is speckled. When a deformation of the fiber occurs, even a small amount, the speckle pattern changes and is detected electronically indicating that a disturbance has taken place.

8 Claims, 10 Drawing Figures

FIBER OPTIC INTRUDER ALARM SYSTEM

BACKGROUND AND SUMMARY OF THE INVENTION

The present invention utilizes a multimode optical fiber buried in the ground as an intruder sensor. A coherent light from a laser is directed through a length of the optic fiber and the light emanating from the end of the fiber produces an output light pattern which is best describable as a speckled pattern. When a deformation of the fiber occurs, even by a small amount, the output pattern, i.e. the speckled pattern, changes and is detected electronically indicating that a disturbance of the fiber has taken place. In this invention the fiber itself is the sensing element or transducer.

It has been previously known to utilize illuminated fiber optics in connection with transducers, and an example is the U.S. Pat. No. 3,580,082 having a pressure transducer with a light reflecting membrane in which an optical fiber directs collimated light to the membrane for reflection thereby. U.S. Pat. No. 3,327,584 is similar. Another similar reference is the U.S. Pat. No. 3,831,137 directed to an acoustic optic underwater detector in which light is carried by a fiber and directed towards a reflector. Pressure displaces the reflector to vary the intensity of the light reflected by the reflector. In each of these references, however, light is carried over an optic fiber to a separate transducer while in the present application the fiber itself is the sensing transducer.

Figure 3:
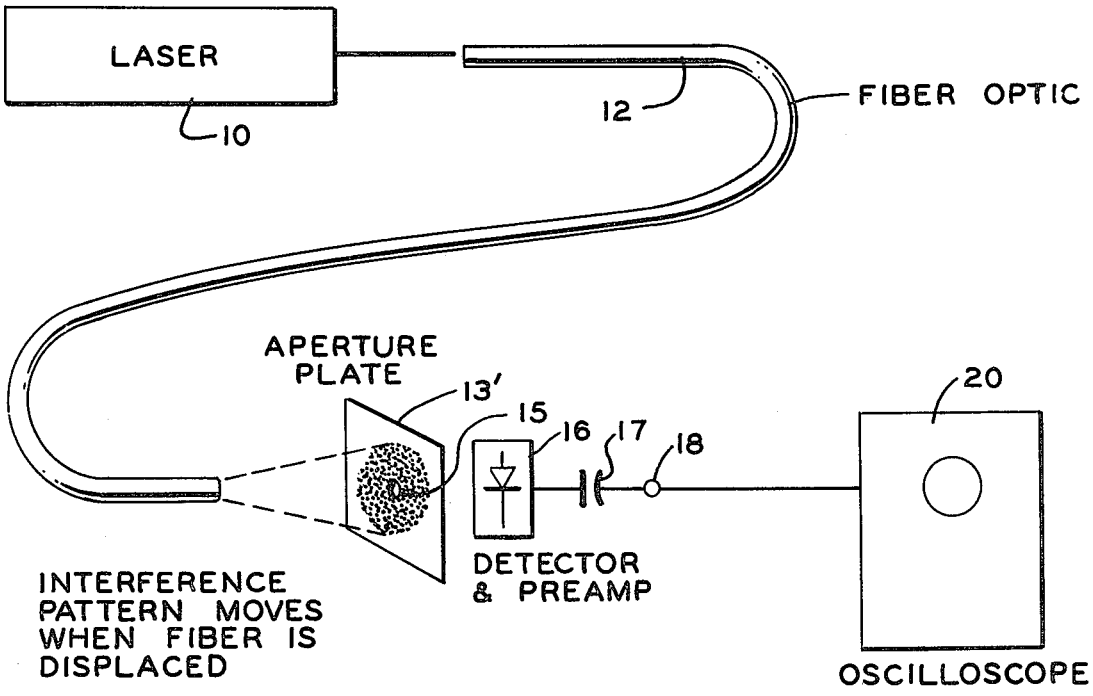
FIG. 3 is a diagrammatic sketch of an embodiment of the invention.

FIG. *3a* is a diagrammatic sketch of a variation of the embodiment of FIG. 3.

Figure 4:
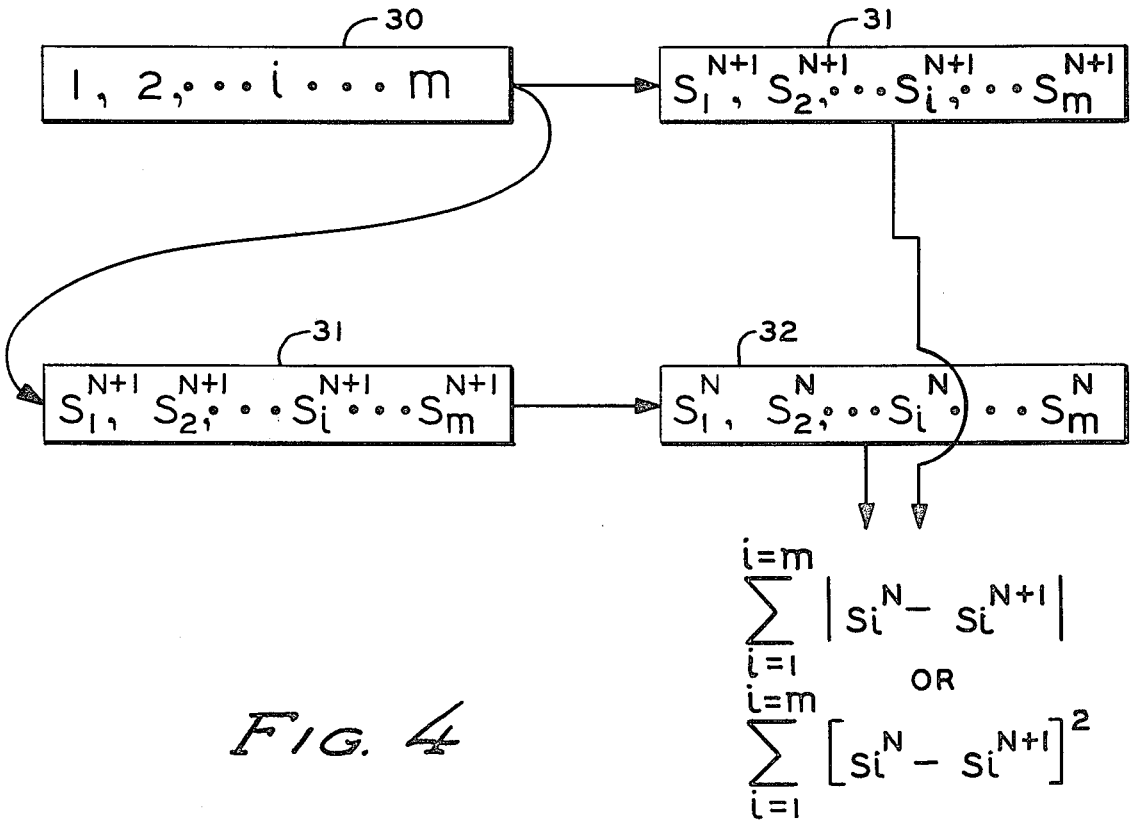

FIG. 4 is a partial block diagram, partial flow diagram illustrating another embodiment of the invention.

Figure 5:
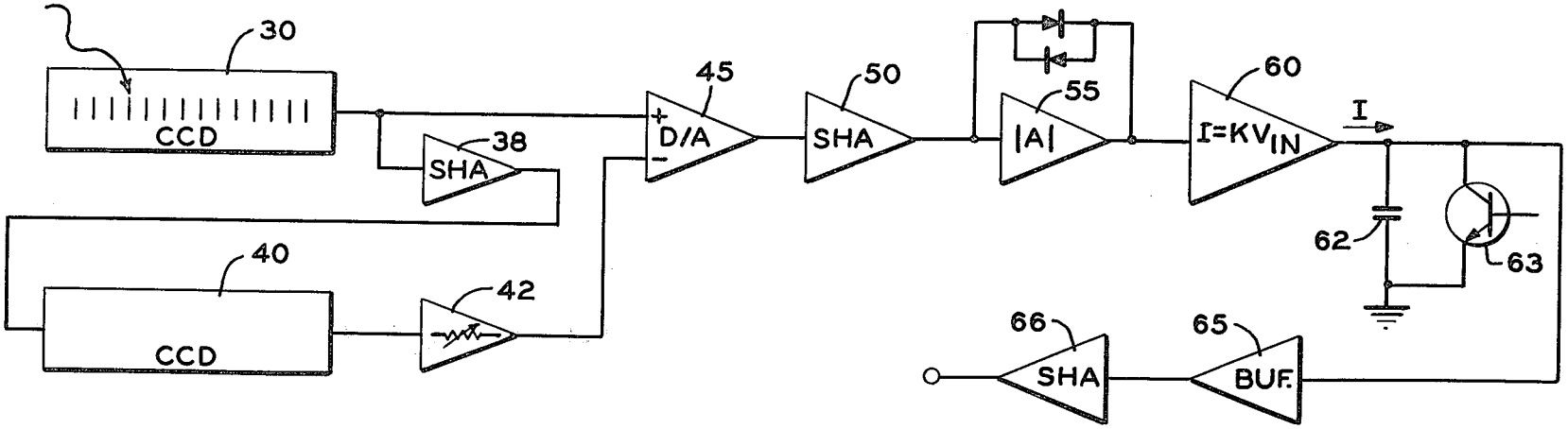

FIG. 5 is a schematic presentation of the embodiment illustrated in FIG. 4.

Figure 6:
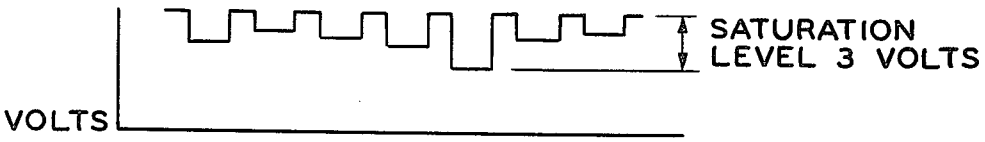
Figure 7A:
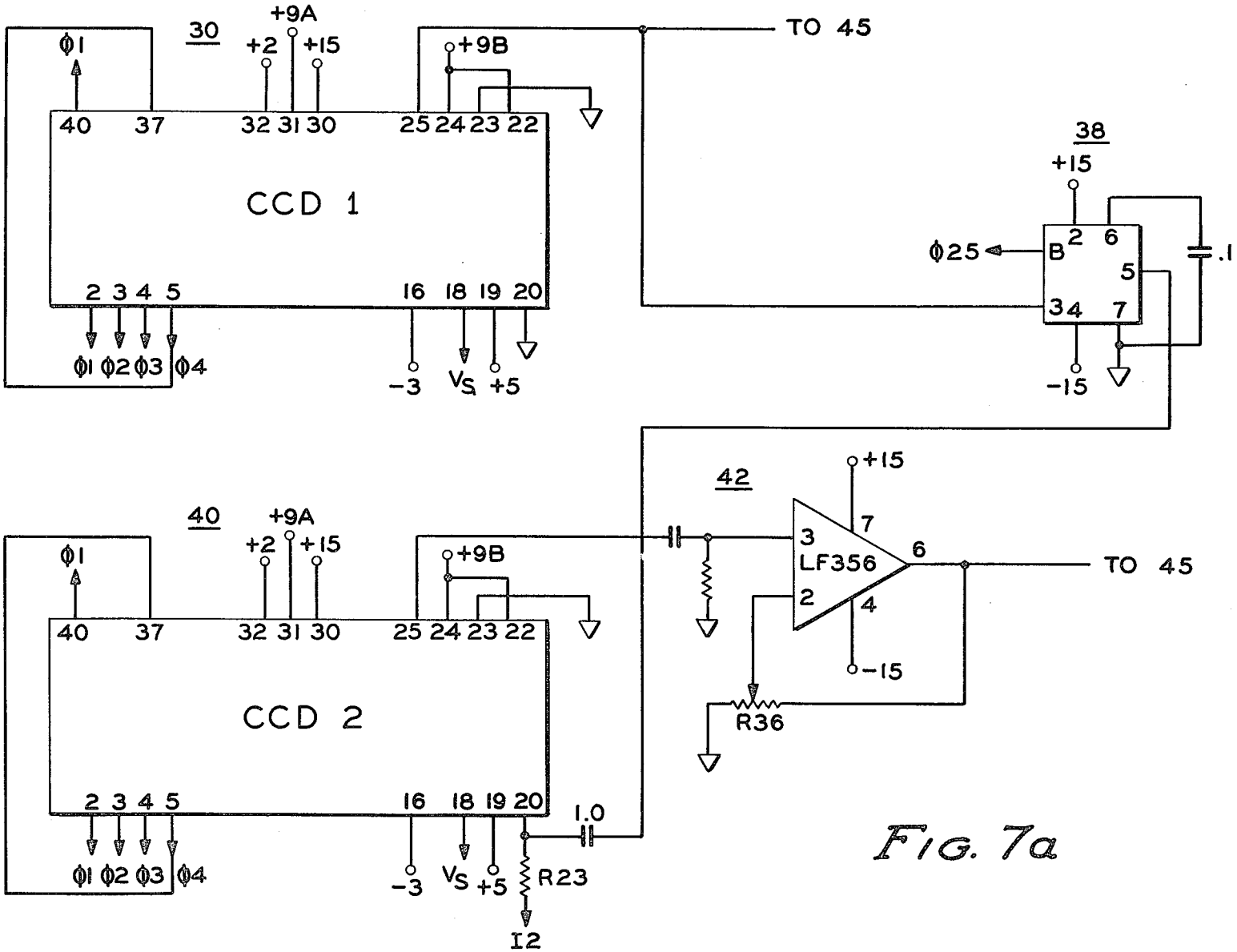
Figure 7B:
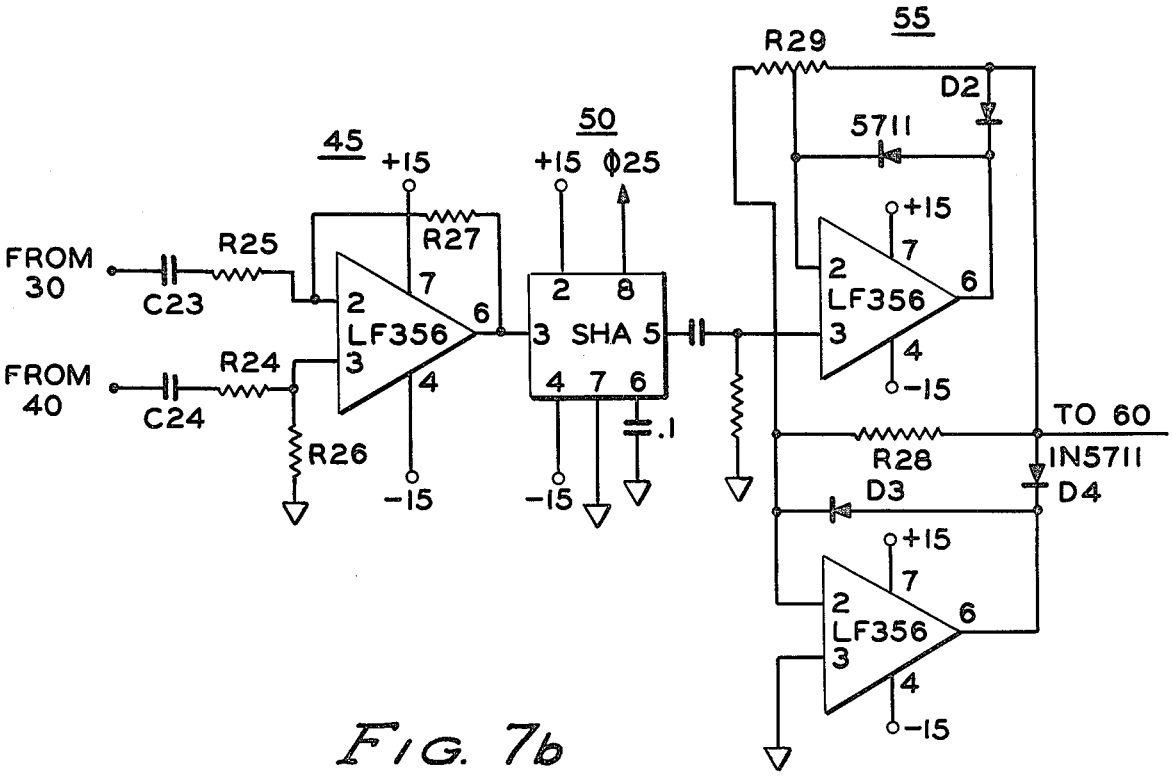
Figure 7C:
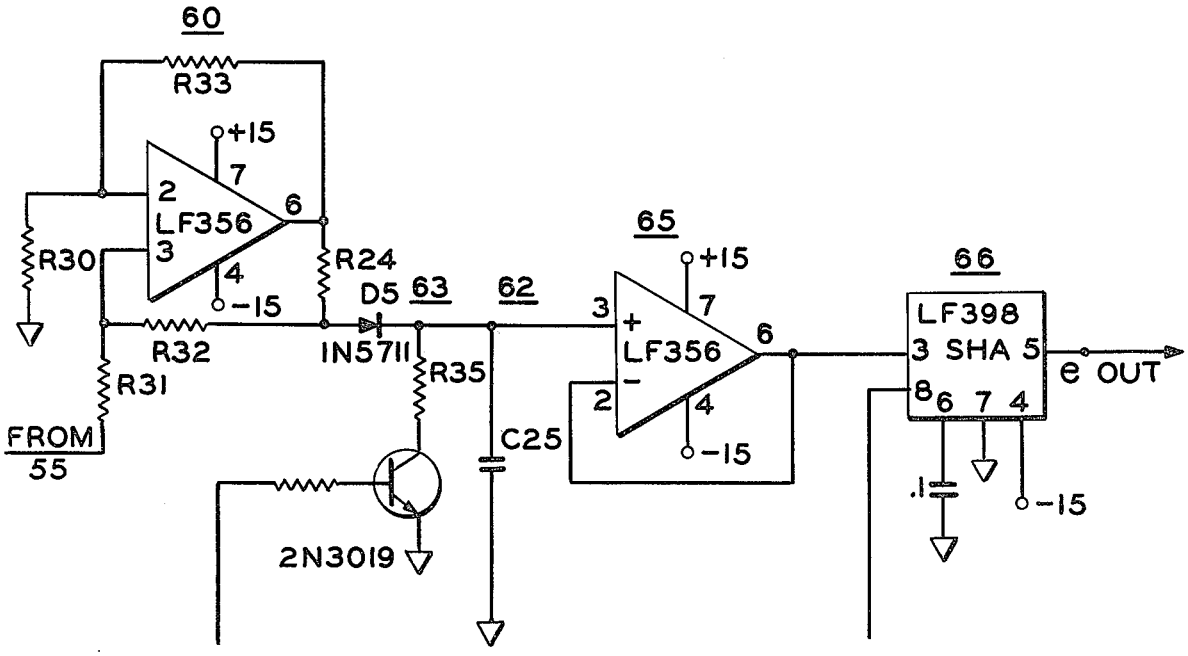

FIG. 6 is a graph showing certain operating waveshapes

FIGS. *7a, 7b* and *7c* show in more detail the schematic of FIG. 5.

DESCRIPTION

Figure 1:
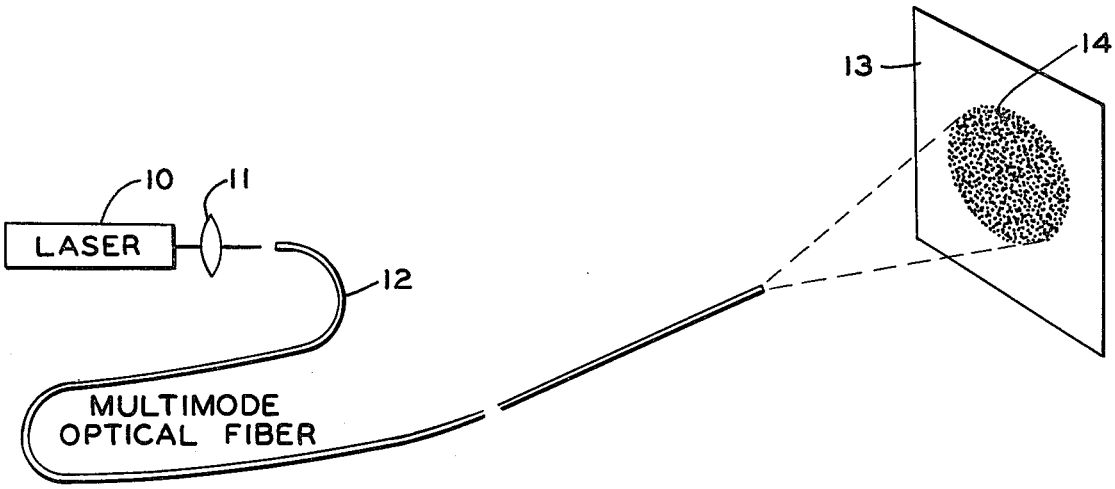
FIG. 1 is a diagrammatic sketch of a simplified embodiment of the invention.
Figure 2:
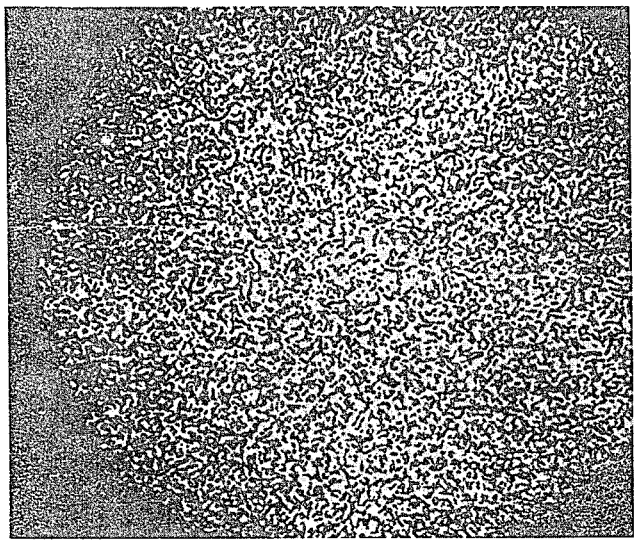
FIG. 2 is a photograph of the speckled output pattern from the optic fiber.
Figure 3A:
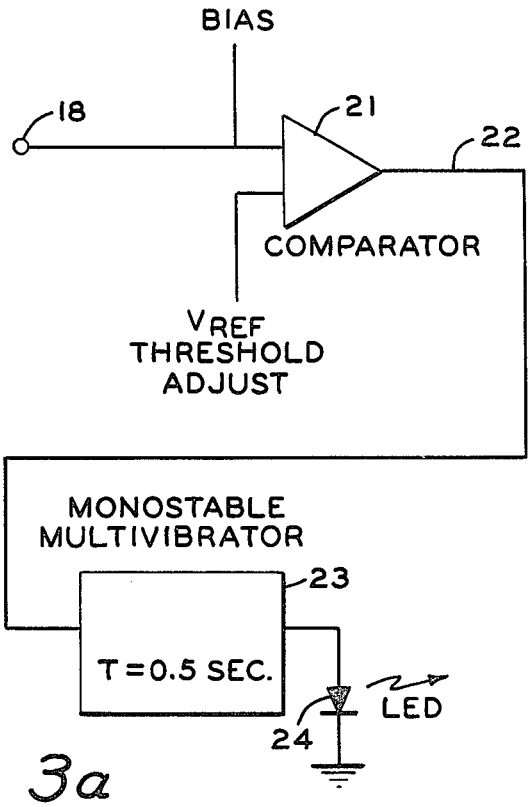

A laser-fiber optic intrusion detector is shown in simplified form in FIG. 1, in which a source of coherent laser light, such as from a He-Ne laser (6328 Å) 10, is directed through suitable lens means 11 and a multimode optic fiber 12. At the output of the fiber the intensity pattern of the light passing out of the end thereof falls into a cone shape which when projected on a plate 13 exhibits a speckled pattern. A photograph of such a speckled pattern 14 is shown in FIG. 2. When the fiber 12 is deformed, even a small amount, the speckled pattern 14 is changed.

FIG. 3 shows a simplified general system similar to FIG. 1 in which the plate 13' has an aperture or pin-hole 15 to permit detection of movement of the speckle pattern. Behind the pin hole is a light-detecting diode and preamp 16. The AC component of the signal from the detector-preamp 16 is coupled by capacitor 17, and further amplification if necessary, to an oscilloscope 20.

In the field test of a fiber optic intrusion alarm apparatus as shown in FIG. 3, the optic fiber was buried beneath 9 inches of damp sand and detected 10 hz 100 pound loads as well as the footsteps of a man walking above it. In this field test the system consisted of a ½ milliwatt helium neon laser, 100 meters of Dupont PFX-S fiber optic cable, an apertured silicon photodetector and an oscilloscope. The helium neon laser radiation was focused onto the end of the fiber optic cable. At the exit end of the fiber optic cable the radiation comes out in a spatially varying intensity pattern. The silicon photodetector with a small aperture placed in front of it intercepts this radiation. When the cable is moved or distorted the speckled pattern changes and the intensity of the radiation which the detector sees through the aperture varies. It is these variations of light intensity falling on the photodetector when the cable is disturbed that form the output signal of the system. The field test facilities consisted of a bed of damp sand approximately 30 feet long, 12 feet wide and 4 feet deep. The optical cable was buried about 9 inches below the surface of the sand for a distance of about 30 feet. The sand was tamped down as the trench was filled helping to produce a stable situation. A mechanical oscillator driven by an air motor was placed directly above the optical cable. This oscillator produced a time varying force normal to the surface of the sand of 100 pounds peak to peak at a frequency of 10 hz. The signal output of the photodetector amplifier was a time varying signal of about 5 millivolts peak to peak. The system also detected the foot steps of a man walking on the sand above the fiber optic cable. The cable was, after being exhumed from the sand, strung through a 10 foot length of copper tubing and again buried at a 9 inch depth. The tests which followed showed that the copper tubing very effectively shielded the cable from any deformation and thus no output signal was received as the test procedures were repeated.

In a modification of FIG. 3 as shown in FIG. *3a*, the signal output from the detector preamp 16 through coupling capacitor 17 is at junction 18 connected to the input of a comparator 21. When a signal from an intruder reaches a desired threshold level, as determined by V ref. threshold adjust, an electrical output from the comparator in line 22 is effective to trigger a monostable multivibrator. The electrical output from multivibrator 23 is connected to energize a light emitting diode 24 to provide a visual signal therefrom.

In a more elaborate embodiment the aperture plate 13' and detector-preamp 16 are replaced by a linear detector array 30 such as for example by a 128 element charge coupled device (CCD). In such a system the speckled radiation pattern at one moment is simultaneously sampled at many points and is compared to the radiation pattern which preceded it in time. Differences between the patterns would signal that the fiber optic cable had been disturbed to indicate an alarm. The response time is arranged so that pattern changes due to slow movements of the fiber optic cable caused by changes in temperature etc. would not trigger an alarm.

FIG. 4 is a partial block, partial flow diagram illustrating a detector array 30, described above, of "m" linear elements which replaces and is positioned at the location of the aperture plate and which simultaneously samples "m" points of the speckled radiation pattern. The information $S_1^{N+1}, S_2^{N+1}, \ldots, S_m^{N+1}$ (generally shown at 31) represents the most recently sampled, in time, radiation pattern. The information $S_1^N$, $S_2^N$, . . . , $S_m^N$ (generally shown at 32) represents the sampled radiation preceding it in time. The comparison of the patterns, referred to above, may be done by a circuit which takes the difference of the patterns. FIG. 4 shows two examples, one in which the summation of the absolute value of the differences of all the elements is taken $$\sum_{i=1}^{i=m} | S_i^N - S_i^{N+1} |$$

and a second example in which it is the square of the difference which is taken $$\sum_{i=1}^{i=m} [S_i^N - S_i^{N+1}]^2$$

FIG. 5 shows a block diagram of the CCD system indicating the important electronic elements and FIGS. *7a, 7b,* and *7c* show the circuit details. The CCD 30 identified above receives the specular light emanating from the end of the optic fiber. The output of CCD 30 is connected to the input of a sample and hold amplifier 38, the output of which is connected to the input of a second CCD 40. The output of CCD 40 is connected through a controllable gain amplifier 42 to the negative input of a differencing amplifier 45. The output of CCD 30 is also connected directly to the positive output of differencing amplifier 45. The output of amplifier 45 is connected to a sample and hold amplifier 50. In this embodiment the sample and hold amplifiers are used for the purpose of strobing the required signals from the CCD output format. Essentially, the CCD output is a 60–80% duty cycle, superimposed on a DC level as represented in FIG. 6. With no light shining on the CCD, the level should be nominally 6–9 volts. As the light intensity is increased, CCD #1 should show a 60–80% duty cycle of the signal that becomes less than the quescent value. As the light increases further, the level should lower 1–3 volts below quiescent and then saturate and hold. The nominal ambient light operating value should be between these values. In processing the data it is important the CCD signal be processed alone and not be integrated with the DC levels that exist. Thus, the sample and hold amplifiers strobe and hold the data for processing in succeeding stages.

The output of sample and hold amplifier 50 is connected to an absolute value amplifier 55, the output signal voltage of which is converted to a current in current source amplifier 60. The signal output current is integrated by reset integrator comprising an integrating capacitor 62 and a reset transistor 63. The output of the capacitor 62 is connected to op amp 65 and into sample and hold amplifier 66. The amplifiers described above may be National Semiconductor Type LF356 and the sample and hold amplifiers may be Type LF398. The LF356 is a BI-FET operational amplifier with a J-FET input device. The LF398 is a monolithic sample and hold circuit using BI-FET technology.

In operation, the speckle pattern of the light is sensed by CCD 30, which is preferably a 128 element CCD. This specular pattern (intensity pattern) of the light fills the different buckets (i.e. the 128 elements) to different levels during an allowed integration time of 50 milliseconds, for example. After the integration period the output of CCD 30 is shifted element by element into CCD 40. This shift period may be in the order of 6 milliseconds, after which the CCD 30 is ready to integrate again. The ratio of integration time to shift period can be modified if desired. Following the first shift, the system is ready to operate since two consecutive sets of data are then present in the CCD's. A bit-by-bit differencing is then done between the two CCD's to determine whether the signal on the element has changed during the integration period. If there was no change in the speckled radiation pattern during the interval, the difference between the corresponding CCD bits is zero as the two CCD outputs are subtracted in the difference amplifier 45. Backing up somewhat in the explanation, the sample/hold amplifier 38 following CCD 30 holds the data output from CCD 30 and allows it to be strobed into CCD 40 at the appropriate time. In order to equalize the outputs of CCD 30 and CCD 40 before entry into the differencing amplifier 45 there is provided controllable gain amplifier 42. This is in part due to the fact that the gain of a CCD operated in this manner as a 128 bit delay line is about 0.3 V/V so that additional amplifier 42 with a gain of approximately 3 is utilized to bring the second CCD level to the level of CCD 30. Adjustment potentiometer R36 (FIG. *7a*) is used to null the signal output from the difference amplifier. When the signal is nulled for a fixed input the two CCD's are balanced in gain.

As shown in FIGS. 5 and *7b,* a sample and hold amplifier 50 follows the differencing amplifier 45 and holds the output from differencing amplifier 45. The absolute value amplifier 55 is used to take only the positive component of the signal. This absolute value amplifier is a precision full wave rectifier with a gain adjustment capability. The output signal is then entered into current source amplifier 60 (a voltage to current converter) which has an output current proportional to its input voltage, the output current being integrated in the capacitor 62. During the CCD shift period (6 msec) a signal level appears at the output of the absolute value amplifier for each bit of the CCD. This signal is then integrated bit by bit during the shift cycle. When the shift cycle is completed, the final integrated value on the capacitor is sampled and held. It represents the output signal. Following the sample time the capacitor is reset to zero and held for the next integration period.

The embodiments of the invention in which an exclusive property or right is claimed are defined as follows:

1. Intruder detector apparatus comprising:

intruder sensor means consisting of a length of multimode optic fiber to be positioned in an area under surveillance for intruders;

means directing a source of coherent light into said optic fiber for transmittal through said length of fiber, said transmitted coherent light emanating from the end of the fiber in a generally cone-shaped beam; and, light detector means receiving at least a portion of the coherent light beam emanating from said fiber, the cross section of the light beam exhibiting an interference pattern of light intensity, and which interference pattern changes when said sensor means is deformed by the presence of an intruder.

2. The apparatus according to claim 1 and further comprising:

interference pattern change recognition apparatus in conjunction with said light detector means for providing an alarm signal upon a change in said interference pattern.

3. The apparatus according to claim 1 wherein said means directing a source of coherent light includes a laser and lens means.

4. The apparatus according to claim 1 wherein the light detector means includes a plate member positioned in the light beam so that the interference pattern is projected thereon.

5. The apparatus according to claim 4 wherein the plate member is an aperture plate and the light detector means further includes a light detecting diode behind the aperture.

6. An intruder alarm system comprising:

laser means for providing a coherent light;

intruder sensor means consisting of a length of multimode optical fiber having at least a portion thereof buried in the earth of an area to be under surveillance;

means directing the coherent light into one end of said optical fiber for transmittal through said length, said transmitted coherent light emanating from the other end of said fiber in a generally cone-shaped beam, the cross section of the coherent light beam exhibiting a speckle pattern of light intensity, and which speckle pattern changes when said fiber is deformed by the presence of an intruder; and, light detector means receiving at least a portion of the coherent light beam emanating from the end of said fiber.

7. The apparatus according to claim 6 and further comprising:

speckle pattern change recognition apparatus in conjunction with said light detector means for providing an alarm signal upon a change in said speckle pattern.

8. Intruder detector apparatus comprising:

intruder sensor means consisting of a length of multimode optic fiber to be positioned in an area under surveillance for intruders, wherein at least a portion of said length of multimode optic fiber is buried in the earth in the area under surveillance;

means directing a source of coherent light into said optic fiber for transmittal through said length of fiber, said transmitted coherent light emanating from the end of the fiber in a generally cone-shaped beam; and, light detector means receiving at least a portion of the coherent light beam emanating from said fiber, the cross section of the light beam exhibiting a speckled pattern of light intensity, and which speckled pattern changes when said sensor means is deformed by the presence of an intruder.

* * * * *